US009722297B2

(12) United States Patent
Yung et al.

(10) Patent No.: US 9,722,297 B2
(45) Date of Patent: Aug. 1, 2017

(54) DIELECTRIC LOADED ELLIPTICAL HELIX ANTENNA

(75) Inventors: Kai Ning Yung, Fotan (HK); Pak Wai Chan, Kwun Tong (HK); Hang Wong, Kowloon (HK); Wenquan Che, Nanjing (CN)

(73) Assignee: City University of Hong Kong, Hong Kong (HK)

( * ) Notice: Subject to any disclaimer, the term of this patent is extended or adjusted under 35 U.S.C. 154(b) by 802 days.

(21) Appl. No.: 12/974,810

(22) Filed: Dec. 21, 2010

(65) Prior Publication Data

US 2012/0154251 A1 Jun. 21, 2012

(51) Int. Cl.

| | |
|---|---|
| ***H01Q 1/38*** | (2006.01) |
| ***H01Q 1/22*** | (2006.01) |
| ***H01Q 7/06*** | (2006.01) |
| ***H01Q 11/08*** | (2006.01) |

(52) U.S. Cl.

CPC ..... *H01Q 1/2216* (2013.01); *H01Q 7/06* (2013.01); *H01Q 11/08* (2013.01)

(58) Field of Classification Search

USPC ..... 343/895

See application file for complete search history.

(56) References Cited

U.S. PATENT DOCUMENTS 7,173,576 B2 * 2/2007 O'Neill et al. ..... 343/895
7,286,099 B1 * 10/2007 Lier et al. ..... 343/895

OTHER PUBLICATIONS

Kraus, J.D., "Antennas", New York: McGraw-Hill, chapter 8, pp. 333-338.

Wu, Z.H.; Che, W.Q.; Fu, B.; Lau, P.Y.; Yung, E.K.N.; Axial mode elliptical helical antenna with parasitic wire for CP bandwidth enchancement: Microwaves, Antennas & Propogation, IET, vol. 1, Issue 4, Aug. 2007 pp. 943-948.

Hui, H.T.; Yung, E.K.N.; Bo, Y.M.; "Experimental and theoretical studies of a DR loaded helical antenna" Antennas and Propagation Society International Symposium, 1995 , vol. 4, Jun. 18-23, 1995 pp. 1887-1890.

* cited by examiner

*Primary Examiner* — Graham Smith

(74) *Attorney, Agent, or Firm* — Renner, Kenner, Greive, Babak, Taylor & Weber Co. LPA

(57) ABSTRACT

An integrated wire elliptical helical antenna with novel cuboids dielectric resonator loading for circularly polarized wave transmission and reception is presented. The antenna is designed to operate in the center frequency of 915 MHz and it is utilized in RFID systems as a base station antenna. The elliptical structure is formed by steel wire and supporting acrylic plastic. The cuboids dielectric resonator is loaded at the inner surface of the proposed antenna.

18 Claims, 10 Drawing Sheets

(a) (b)

DIELECTRIC LOADED ELLIPTICAL HELIX ANTENNA

FIELD OF THE INVENTION

The present invention relates to an integrated wire elliptical helical antenna for circularly polarized transmission and reception of signals and to an electronic apparatus or system including such an antenna.

BACKGROUND OF THE INVENTION

With increasing demands on commercial data transmission applications such as radio frequency identification (RFID) tag applications, attention has been applied to the design of compact integrated and directional antennas with circular polarization and good matching performance. Traditionally, engineers prefer deploying patch antennas in RFID systems because patch antennas have many advantages such as having a low profile, being conformal to planar surfaces, and the ability to integrate the antenna with a printed circuit such as a monolithic microwave integrated circuit (MMIC).

Antennas for RFID readers should be directional, but conventional circularly polarized patch antennas suffer from narrow bandwidth and the directivity of patch antennas is not high enough for them to function as a good RFID base station antenna. Some proposed techniques such as increasing the thickness of the patch antenna, employing a capacitive coupled feed or an L-probe feed can overcome the narrow bandwidth problem. Furthermore, a patch antenna array is one way to achieve high directivity signal radiation, but this comes at the cost of a large overall size and cost of the patch antenna array.

For cost effectiveness and space utilization, wideband, high gain, low profile and circularly polarized wave radiating antennas that can accommodate several communication systems are in high demand. In particular, antennas with directional radiation patterns are of interest as they can be mounted on walls, or other objects such as vehicles, without degrading their electrical properties. Axial mode helix antenna designs are another suitable candidate to be used as a RFID base station antenna. Helix designs produce a directional antenna pattern, generate circularly polarized radio waves, and have a wide operational frequency bandwidth. However, the large pitch angle for the traditional axial mode helix antenna prevents the fabrication of a low-profile antenna. The circumference of the axial mode helix is around one wavelength and the optimum pitch angle according to Kraus is 12.5° [see: Kraus, J. D., "Antennas", New York: McGraw-Hill, chapter 8, pp. 333-338]. To achieve a relatively narrow beamwidth helix at 915 MHz, the number of windings of the helix should at least 10. In other words, the physical height of the axial mode helix will be too high to be a good RFID base station antenna.

It is known that if a conventional circular helix is deformed into an elliptical one, then circular polarized waves can be restored by winding two helical antennas on a common elliptical core [see: Wu, Z. H.; Che, W. Q.; Fu, B.; Lau, P. Y.; Yung, E. K. N.; "Axial mode elliptical helical antenna with parasitic wire for CP bandwidth enhancement" Microwaves, Antennas & Propagation, IET, Volume 1, Issue 4, August 2007 Page(s):943-948].

OBJECTS OF THE INVENTION

An object of the invention is to mitigate or obviate to some degree one or more problems associated with known integrated wire helical antennas.

The above object is met by the combination of features of the main claim; the sub-claims disclose further advantageous embodiments of the invention.

Another object of the invention is to provide an improved integrated wire elliptical helical antenna for circularly polarized signal transmission and reception.

Another object of the invention is to provide an apparatus such as a base station having an improved integrated wire elliptical helical antenna for circularly polarized signal transmission and reception.

One skilled in the art will derive from the following description other objects of the invention. Therefore, the foregoing statements of object are not exhaustive and serve merely to illustrate some of the many objects of the present invention.

SUMMARY OF THE INVENTION

According to the present invention there is provided an antenna comprising a helical winding with a loading formed of a dielectric material, wherein said dielectric material comprises a plurality of individual dielectric elements arranged together to form a generally tubular structure adjacent the helical winding, said helical winding having a longitudinal axis whereby a cross-sectional area of said helical winding in a plane perpendicular to said longitudinal axis has a major axis and a minor axis perpendicular to the major axis.

The one or more of the individual dielectric elements may have a square cross-sectional area in the plane perpendicular to the longitudinal axis of the helical winding. Preferably, each of the individual dielectric elements has a square cross-sectional area in a plane perpendicular to the longitudinal axis of the helical winding. Preferably also, the individual dielectric elements have a square cross-sectional area in the plane perpendicular to the longitudinal axis of the helical winding along a major part of their lengths.

The helical winding may be substantially elliptical in the plane perpendicular to the longitudinal axis of said helical winding. Alternatively or additionally, the helical winding may not be uniformly elliptical in the plane perpendicular to the longitudinal axis of the helical winding. For example, the helical winding may be ovoid in the plane perpendicular to the longitudinal axis of the helical winding.

Preferably, the dielectric elements are elongate cuboid elements. The dielectric elements may extend for the full or a major part of the height of the antenna. In some embodiments, the dielectric elements are shorter than the height of the antenna. In some embodiments, the spacing between the winding and the dielectric elements may be uniform and the dielectric elements may be provided on the inside of the helical winding.

The antenna may comprise a feed probe arranged as a side feed for the antenna. The feed probe may comprises a straight metallic strip, and a matching circuit.

Preferably, the helical winding is formed from at least one elongate, electrically conductive element. The at least one elongate, electrically conductive element may comprise a metal wire. The at least one elongate, electrically conductive element may comprise a first main elongate, electrically conductive element and a second, parasitic elongate, electrically conductive element.

The invention may also provide an electronic apparatus having an antenna according to the invention.

The invention may also provide a radio frequency identifier (RFID) base station comprising at least one antenna according to the invention.

The main statement of invention in the summary of the invention does not necessarily disclose all the features essential for defining the invention; the invention may reside in a sub-combination of the disclosed features found in said main statement.

BRIEF DESCRIPTION OF THE DRAWINGS

Some embodiments of the invention will now be described by way of example and with reference to the accompanying drawings, in which.

DETAILED DESCRIPTION OF PREFERRED EMBODIMENTS

The following description is of preferred embodiments by way of example only and without limitation to the combination of features necessary for carrying the invention into effect.

As will be seen in the following description, in preferred embodiments of the present invention, a relatively narrow beamwidth, wideband with low profile helical antenna 100 which preferably operates in the radio frequency (RF) range of 880 MHz to 940 MHz is described. This antenna 100 is fabricated from a helix 10 of any suitable elongated conducting material (e.g. 6 or more turns which may be modified depending on the desired radiation beamwidth), preferably metal wire such as steel or copper wire, and employs an acrylic plastic as a supporting platform.

Figure 1:
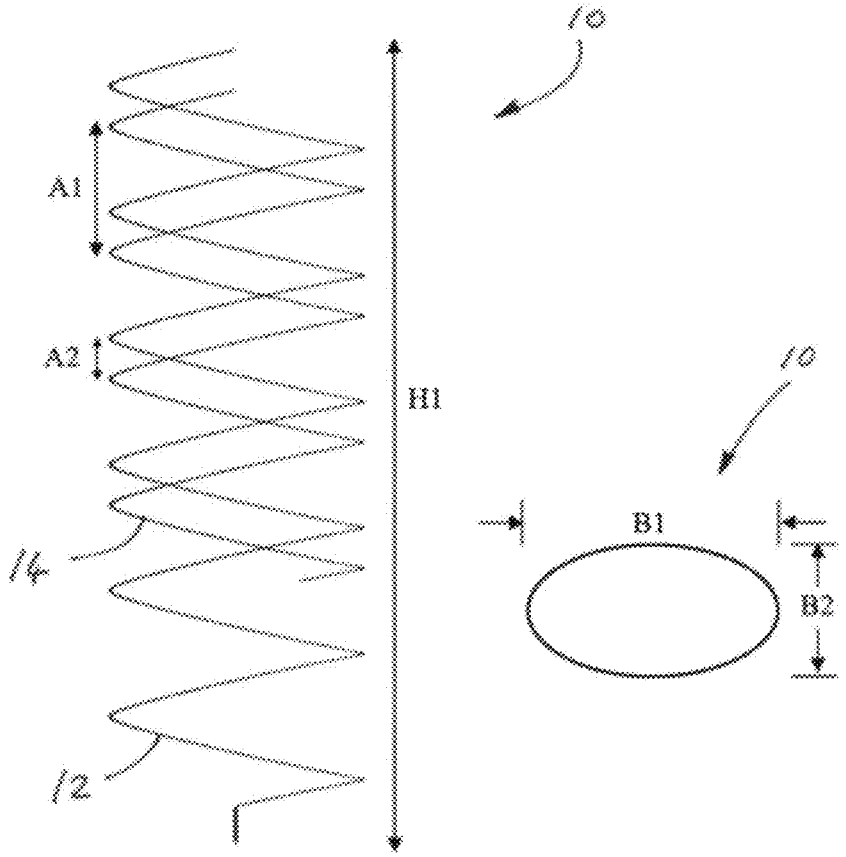
FIG. 1 illustrates the geometry of a helix antenna geometry showing (a) a side view of the elliptical helix and (b) a top view of the elliptical helix.

FIGS. 1(*a*) and (*b*) illustrate the geometry of a helix antenna geometry suitable for embodiments of the invention showing (a) a side view of the elliptical helix 10 and (b) a top view of the elliptical helix 10.

In FIGS. 1(*a*) and (*b*):

H1 comprises the total height of the helix 10;

A1 comprises the turn spacing of the helix 10;

A2 comprises the shifted spacing between a first, main helical wire 12 and a second, parasitic helical wire 14;

B1 comprises the major axis of the helix 10, i.e. the largest separation between two opposite points on a core of the elliptical helix; and B2 comprises the minor axis of the helix 10, i.e. the smallest separation between two opposite points on the elliptical core.

Depending on the starting location of the second parasitical coil 14, a unity axial ratio can be reinstated. However, even with the shape deformation to elliptical, a helical antenna using such an elliptical element 10 is, without further modification, still large in size and thus too large for many applications. Some designers have proposed to use a dielectric resonator ceramic tube to further reduce the size of the helical antenna by loading it in the inner portion or core of the helix element [see: Hui, H. T.; Yung, E. K. N.; Bo, Y. M.; "Experimental and theoretical studies of a DR loaded helical antenna" Antennas and Propagation Society International Symposium, 1995, Volume 4, 18-23, June 1995, Pages 1887-1890]. However, experiments show that when the dielectric resonator is in a cylindrical tubular form instead of a solid form, the performance including the gain and axial ratio is generally similar in each case. Therefore, although it is preferable that an elliptically shaped dielectric resonator cylindrical tube is used, not only are the rigid properties of the material hard to deform into an elliptical shape, but also the cost is still very high.

Figure 2:
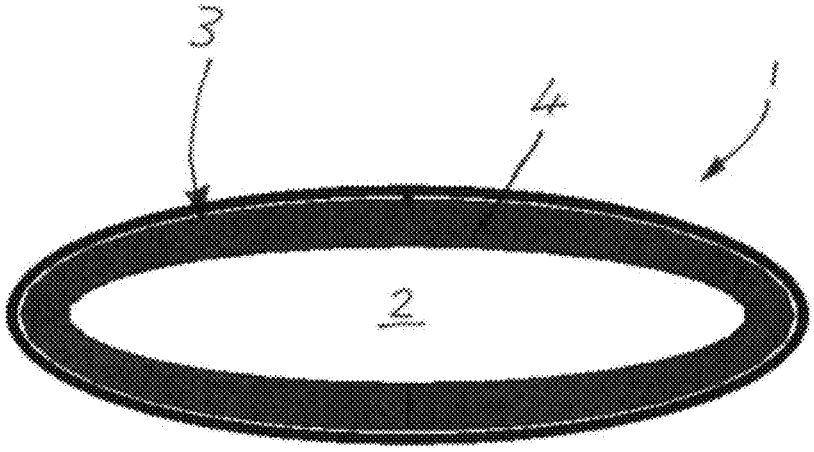
FIG. 2 illustrates the top view of an antenna with whole dielectric resonator loading.

FIG. 2 illustrates a top view of an antenna 1 with whole dielectric resonator loading within a core 2 of the elliptical helix structure 3 according to one conventional method of forming an antenna 1. In the method as shown in FIG. 2, a solid tube 4 of dielectric resonator material of elliptical cross-section is deployed within the core 2 of the elliptical helix structure 3, but the solid tube 4 of dielectric resonator material of elliptical cross-section is heavy in weight and very expensive to manufacture.

In contrast, FIG. 3 illustrates the geometry of an antenna 100 according to an embodiment of the invention in (a) side view and (b) top view with cuboids dielectric resonator loading, although the top view excludes the ground plane components.

Figure 3A:
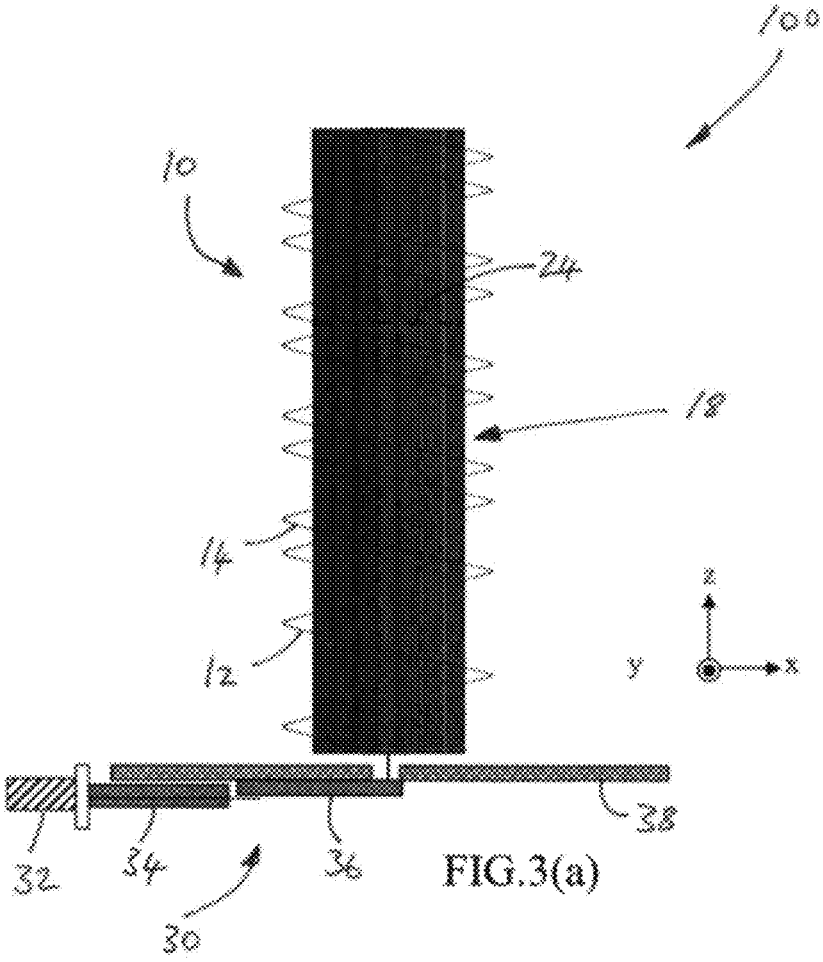
FIG. 3 illustrates the geometry of an antenna according to an embodiment of the invention in (a) side view and (b) top view with cuboids dielectric resonator loading.
Figure 3B:
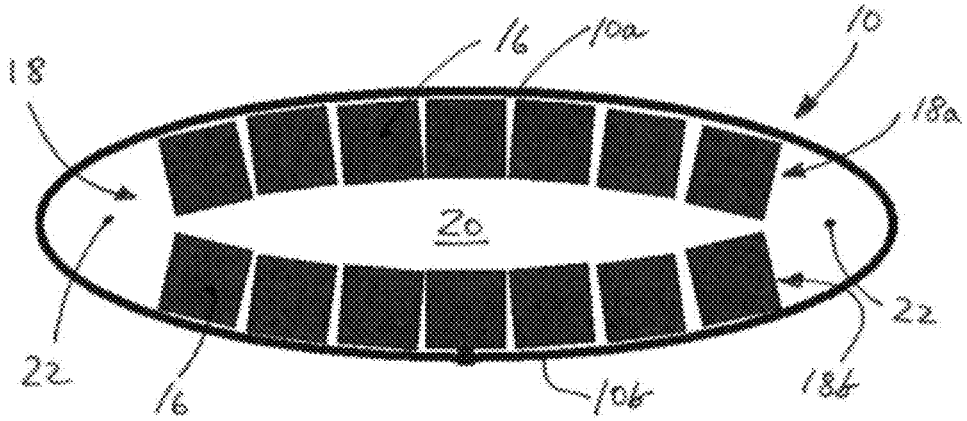

In embodiments of the invention as illustrated by FIG. 3, a plurality of dielectric elements 16 of dielectric resonant material or materials are used to form an elliptical dielectric resonator structure 18 for placing within a core 20 of the elliptical helix element 10 of the antenna 100. Preferably, each of the plurality of dielectric elements 16 is an elongated cuboid shaped element. Preferably also, the plurality of dielectric elements 16 are arranged as shown in FIG. 3*b* to generally define a cylindrical dielectric resonator structure 18, albeit one formed of a plurality of individual dielectric elements linked together rather than a single solid resonator (FIG. 2) as is already known. The plurality of elements 16 may be arranged such that there are no gaps therebetween, but preferably they are arranged as depicted in FIG. 3*b*, namely the elements 16 are each square in cross-section when viewed from above and arranged side by side to form the cylindrical resonator structure 18 such that they are placed closely together. Adjacent elements may be placed such that their innermost corners (corners nearest the core 20) touch an adjacent element, but that they are spaced apart at their rearmost corners (outer corners). Of course, the elements may be of other cross-sectional shapes, but one advantage of forming all of the elements 16 to have the same, uniform cross-section shape is ease of manufacture and thus reduced cost.

The plurality of elements 16 may be arranged in at least two sets to occupy respective portions 10*a*, 10*b* of the elliptical circumference of the helix core 20, e.g. as shown in FIG. 3*b*. The plurality of elements 16 may be arranged in first and second sets with one set occupying most of a first side portion 10*a* of the circumference of the core 20 of the helix generally along its major axis and the second set occupying most of an opposing side portion 10*b* of the circumference of the core 20 of the helix also generally in line with its major axis. This arrangement leads to relatively large spaces 22 between end elements 16 of the first and second sets of elements at the apogees of the helix core 20 circumference, but this has not been found to have an adverse effect on performance of the antenna constructed according to FIG. 3. The first and second sets of cuboid dielectric resonator elements may be formed as first and second resonator structures 18*a*, 18*b* for easy insertion into the core 20 of the helix 10 when manufacturing the antenna 100.

It can be seen therefore that, in embodiments of the invention, the antenna 100 is loaded with a dielectric resonator structure 18 constructed of a plurality of cuboid elements 16 that together form an elliptical DR cylinder. As can be seen from FIG. 3*b*, the antenna 100 is loaded with a dielectric resonator structure 18 formed of fourteen cuboid elements 16 arranged in two rows or sets of seven about the elliptical core 20 circumference. The dielectric resonator structure 18 is fixed to an inner side of the wire surface of the antenna helix 10. The helix comprises a first, main helical wire 12 and a second, parasitic helical wire 14 in an arrangement as already described with respect to FIG. 1. The elliptical tube structure 18 is thereby formed by 14 cuboid DR elements on one elliptical circumference. Each cuboid element 16 may extend vertically for the full height of the antenna helix 10. Alternatively the cuboid elements 16 may extend only for a part of the height of the helix 10 in which case one or more further groups of vertically arranged or stacked (as viewed in FIG. 3*a*) cuboid elements 16 may be required to cover the complete height of the helix 10. For example only, a first group of cuboid elements 16 may extend for only one third the height of the antenna helix 10 (as denoted by broken line 24 in FIG. 3*a*) in which case three shells or groups of resonator elements 16 each comprising 14 individual cuboid elements 16 (i.e. 42 in total) would be required to completely load the core 20 elliptical antenna 100 through the height of the helix 10.

A dielectric material is a substance that is a poor conductor of electricity, but an efficient supporter of electrostatic fields. In practice, most dielectric materials are solid. Examples include porcelain (ceramic), mica, glass, plastics, and the oxides of various metals. These and other types of dielectric materials, suitably formed into cuboid elements 16, can be implemented in the antenna 100 of the present application. The cuboid dielectric resonator (DR) materials used in the present application preferably, but not exclusively, comprise a conventional DR material with a dielectric constant equal to 10 ($\in r=10$). The range of possible conventional dielectric constants can range from 2 to 80. It has been found, however, that the higher the dielectric constant utilized, the smaller the resulting antenna size, but the cost also increases significantly for DR materials having a high dielectric constant. Thus, a choice is made to have a DR material that allows the antenna to be made smaller than conventional antennas, but using a material that is not of excessively high cost. However, it will be understood that, dependent on the requirements of an antenna, the DR material may have a dielectric constant in the range of 10 to 70 for general application or 50 to 80 for more specific applications such as military applications, for example.

Simulations show that the performance of the antenna 100 using dielectric resonator (DR) cuboids 16 is very similar in terms of return loss, gain and the size reduction to that using a conventional solid DR tube (FIG. 2). Antennas 100 according to embodiments of the invention exhibit performance characteristics such as gain and circular polarization similar to the traditional helix 1 of FIG. 2, but with in the order of a six times height reduction. Furthermore, the use of individual dielectric elements 16 to form a generally cylindrical resonator structure 18 for the antenna 100 greatly reduces cost, improves versatility in antenna design and simplifies manufacture of the antenna 100.

Figure 4:
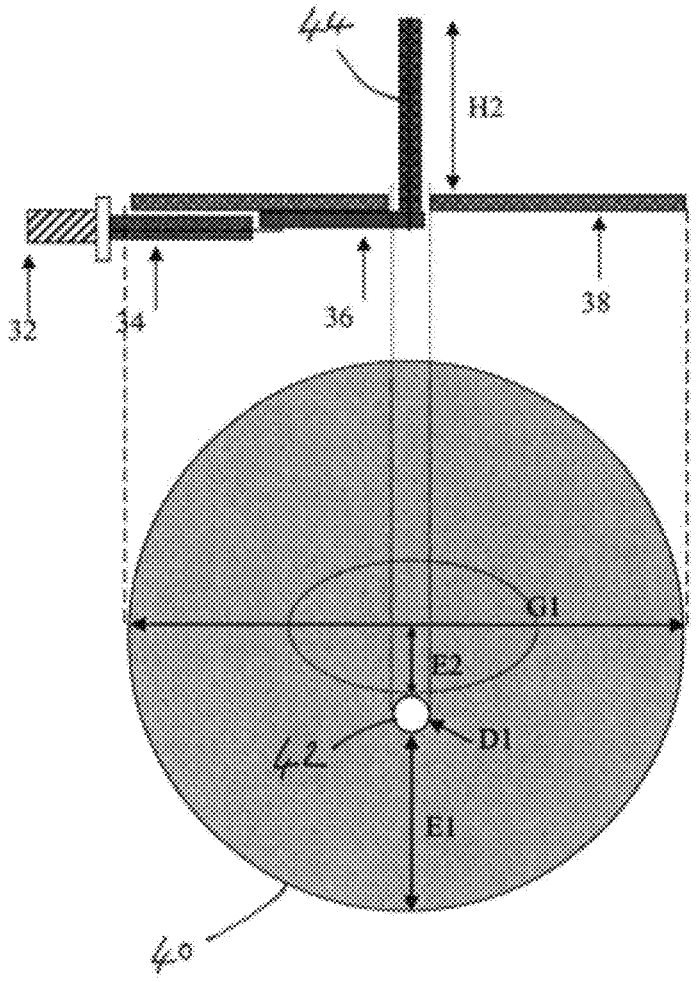
FIG. 4 illustrates the feeding geometry of the antenna of FIG. 3 as well as the geometry of a ground plane for the antenna.
Figure 5:
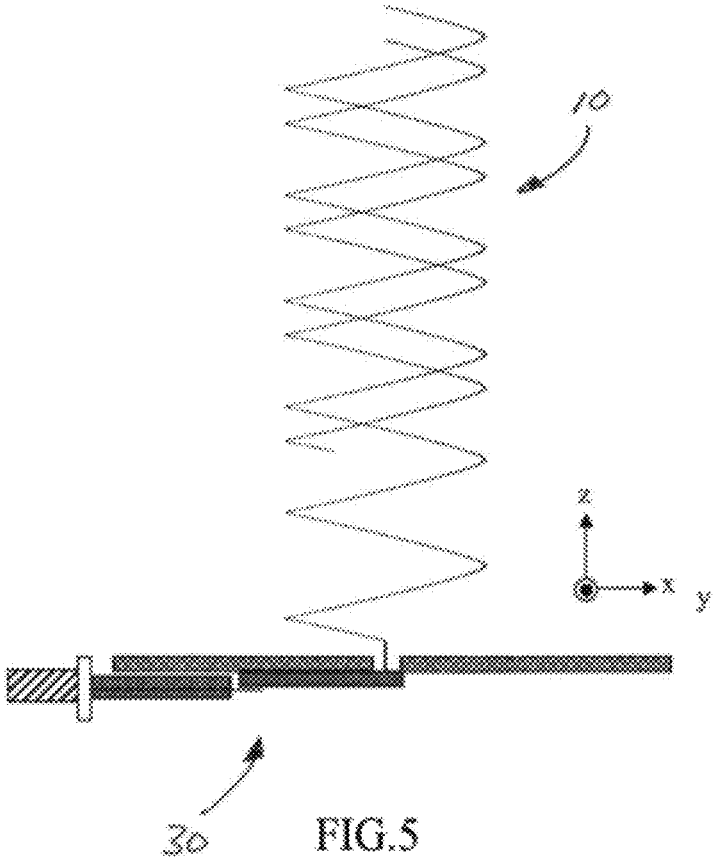
FIG. 5 illustrates the geometry of the antenna of FIG. 3 without dielectric resonator loading.

Shown in FIG. 3*a* as well as FIGS. 4 and 5 is the ground plane module 30 for the antenna 100. FIGS. 4 and 5 illustrate the geometry of the ground plane module 30, but FIG. 4 does not include the helix 10 and FIG. 5 does not show the dielectric resonator structure of the antenna 100 for reasons of convenience. The ground plane module 30 comprises a SubMinature Version A (SMA) connector 32, a coaxial cable 34, a printed circuit board (PCB) 36 and a metal ground plane 38, preferably an aluminium ground plane 38.

In a practical embodiment of the antenna 100 according to the invention, the dimensions of the ground plane module components are as provided in Table 1. FIG. 4 includes a top view of a footprint 40 of the antenna ground plane module 30. The diameter of the aluminium ground plane 38 is represented by G1. A hole 42 with diameter D1 is drilled in the aluminium ground plane 38 for feeding the antenna 100. E1 and E2 represent the location of the hole. The antenna has a supporting platform of acrylic paste (not shown). The antenna helix 10 is located as shown on top of the ground plane 38. A matching circuit formed on the PCB 36 is located on the bottom of the ground plane 38. The ground plane 38 may be circular in cross-section as seen in FIG. 4, but it may also be any shape in cross section such as rectangular or square. The antenna 100 and PCB 36 are connected together through the hole by an antenna feedline or feed probe 44.

In one embodiment of the invention, the geometry of the helix antenna 100 is such that the circumference of the helix antenna 100 is 723 mm and the feed probe 44 length is H2=10 mm. The spacing of the elliptical antenna is 54.4 mm, with minor axis 68.2 mm and a major axis 215.4 mm. The minor and major axes can be chosen depending on the desired resonant frequency of the antenna. The diameter of the helix wires 12, 14 is 1 mm.

Figure 6A:
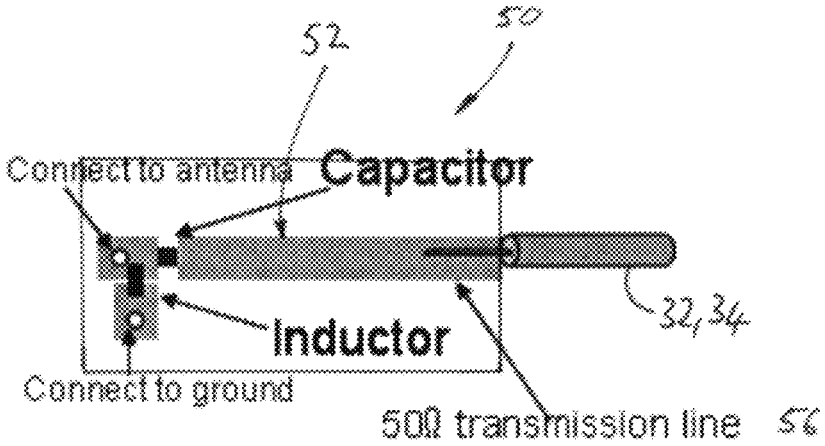
FIG. 6 shows (a) a block diagram of the PCB feeding network and (b) the geometry of the associated circuit board.
Figure 6B:
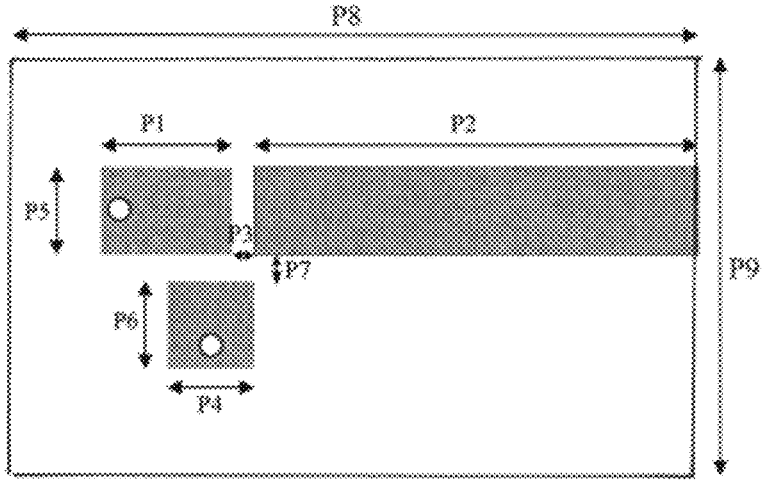

Referring to FIG. 6 which shows (a) a block diagram of a PCB feeding network and (b) the geometry of an associated circuit board, one way to excite the antenna 100 is to use a coaxial probe feed 50 (FIG. 6*a*) comprising three portions. The first portion is a vertical straight metallic strip which is vertically oriented and has one end connected to the PCB matching circuit 52 underneath the ground plane 38. This portion acts as a capacitive reactance to compensate for the inductive reactance caused by the compression of the pitch angle with proven measured and simulated results. The second portion is the matching circuit 54 itself. Because of the wide bandwidth characteristic of the helix 10, a simple matching circuit 54 composite of micro strip transmission lines together with an inductor and a capacitor can easily compensate the mismatched helix 10. FIGS. 6(*a*) and (*b*) illustrate the matching circuit and Table 2 below gives examples of parameter values for the matching circuit 54. The third portion is the 50 ohm coaxial cable 32 with the SMA connector 34 which is horizontally oriented and has one end connected to the 50 Ohm open end transmission line 56.

FIGS. 7 to 10 provide simulated performance data for an antenna 100 of the invention having the parameters and dimensions described above with respect to FIGS. 3 to 6 and as set out in Tables 1 and 2.

Figure 7A:
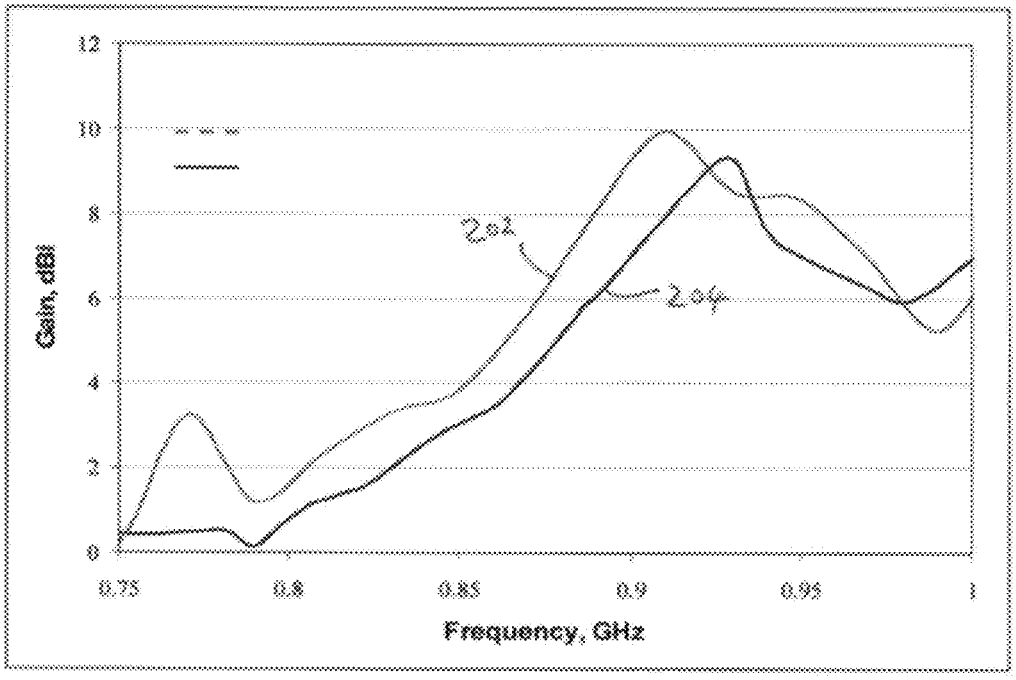
FIG. 7 shows simulated (a) gain and (b) axial ratio comparison for dielectric resonator cuboids loading and whole dielectric resonator cuboids loading.
Figure 7B:
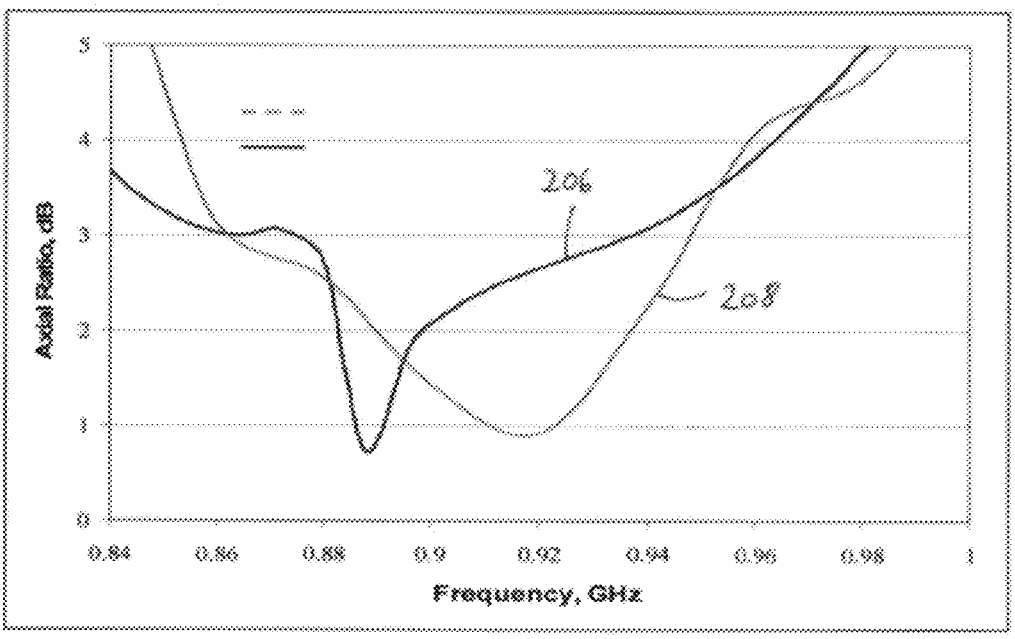

FIG. 7 illustrates the (a) gain and (b) axial ratio bandwidth comparisons between the cuboids DR loaded antenna 100 of an embodiment of the present invention and a solid DR loaded antenna according to the prior art (FIG. 2). The x-axis represents the frequencies of RF waves in giga-hertz (GHz). The y-axis represents the gain in decibel units for FIG. 7*a* and the axial ratio in dB for FIG. 7*b*. The graphs were obtained using an electromagnetic simulator. In FIG. 7(*a*) curve 202 illustrates the gain of the cuboids loaded antenna and curve 204 illustrates the gain of the solid DR tube loaded antenna. Curve 202 shows that the antenna of the invention attains a peak gain of 9.9 dBi at frequency of about 910 MHz. Curve 204 shows that the conventional antenna attains a peak gain of 9.3 dBi at 930 MHz. By the comparison illustrated, the cuboids loaded elliptical antenna 100 of the invention exhibits similar performance in gain compared with the conventional solid tube DR loaded antenna. In FIG. 7(*b*) curve 206 and 208 and 404 illustrate the axial ratio of the cuboids loaded antenna 100 of the invention and the conventional solid tube DR loaded antenna respectively. In curve 206, the axial ratio bandwidth is 9% from 865 MHz to 948 MHz, where in curve 208, the axial bandwidth is 7.1% from 874 MHz to 938 MHz. It can be seen therefore from the comparison that the performance of the cuboids loaded elliptical helix antenna exhibits nearly the same performance as the solid loaded antenna. However, the fabrication cost of the cuboids loaded antenna 100 is much cheaper than the known solid tube loading antenna.

Figure 8:
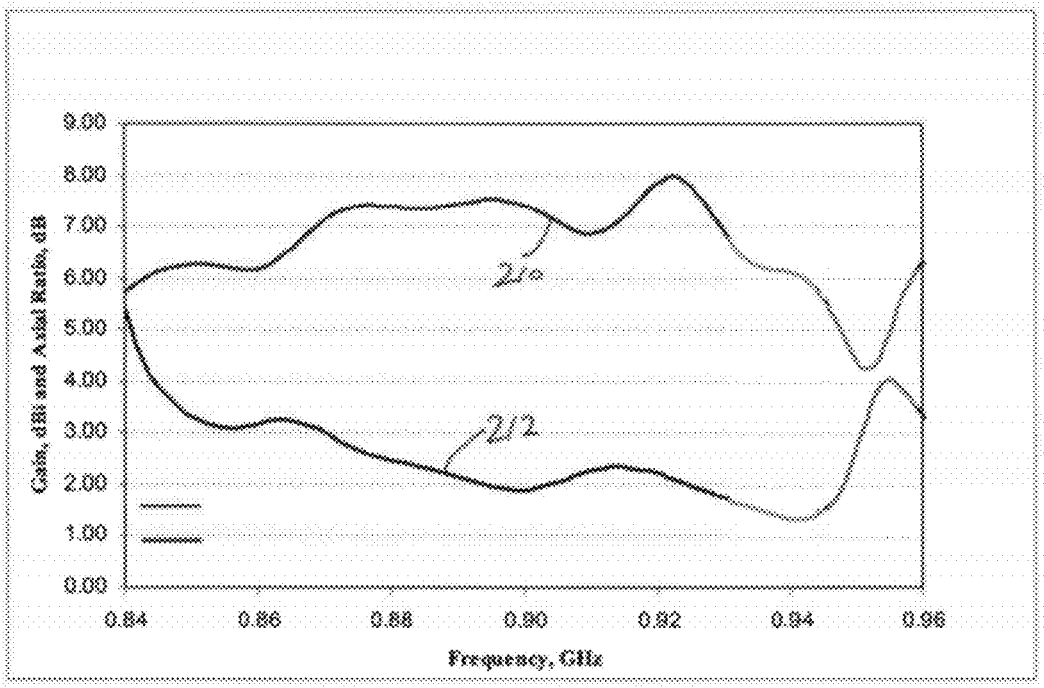
FIG. 8 shows measured gain and axial ratio comparisons against frequency.

FIG. 8 shows a plot of gain 210 and axial ratio 212 of the antenna 100 according to the invention. The peak gain is 8 dBi at 9.2 GHz and the axial ratio bandwidth, with AR<3 dB, around 9% from 0.87 GHz to 0.952 GHz.

Figure 9:
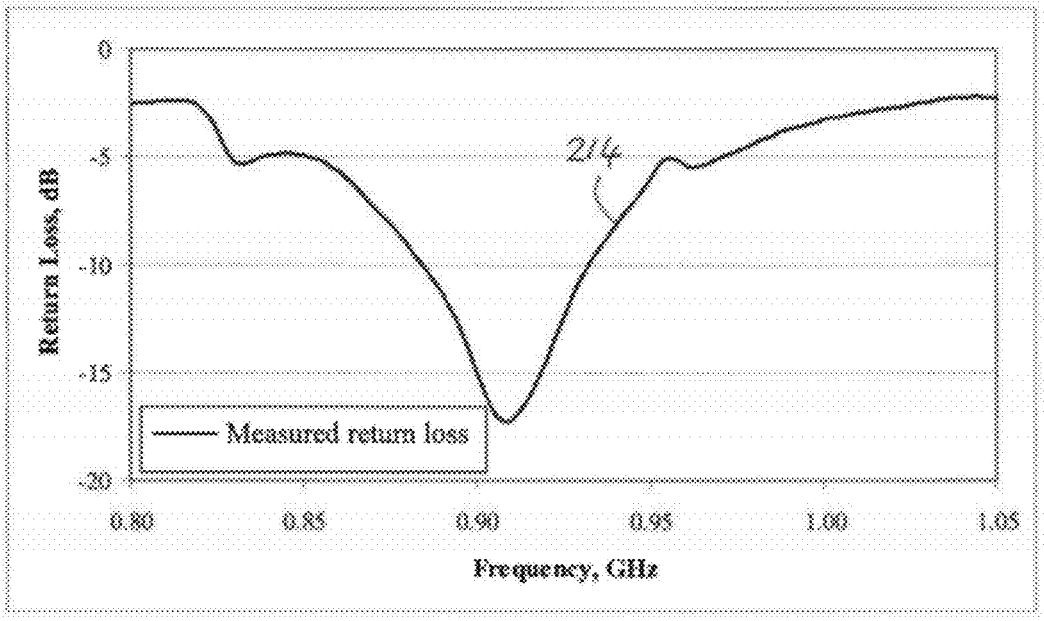
FIG. 9 shows return loss against frequency.

FIG. 9 shows the return loss 214 against frequency for the antenna 100 of the invention. The impedance bandwidth, S11<−10, is around 6.6% from 0.88 GHz to 0.94 GHz.

Figure 10A:
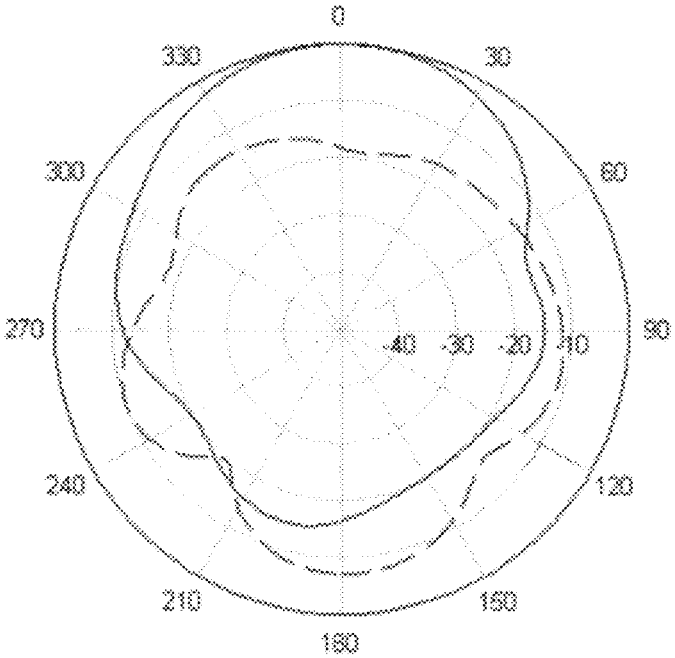
FIG. 10 shows the radiation patterns at (a) Phi=0° and (b) Phi=90°.
Figure 10B:
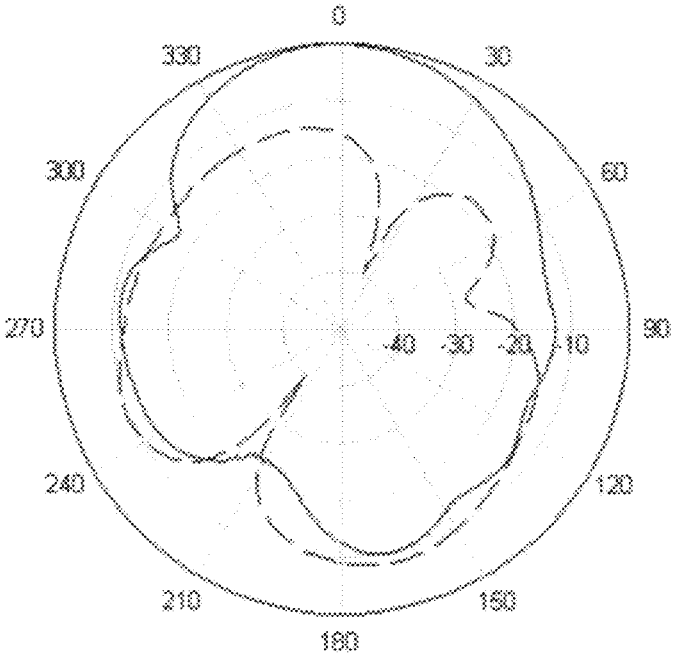

FIG. 10 illustrates the radiation pattern at phi=0 degree and 90 degree for the antenna 100 of the invention. Both radiation patterns were measured at a radiating frequency of 915 MHz. The radiation patterns illustrate that the antenna has a dominate propagation wave front in a direction along the z-axis.

Figure 11:
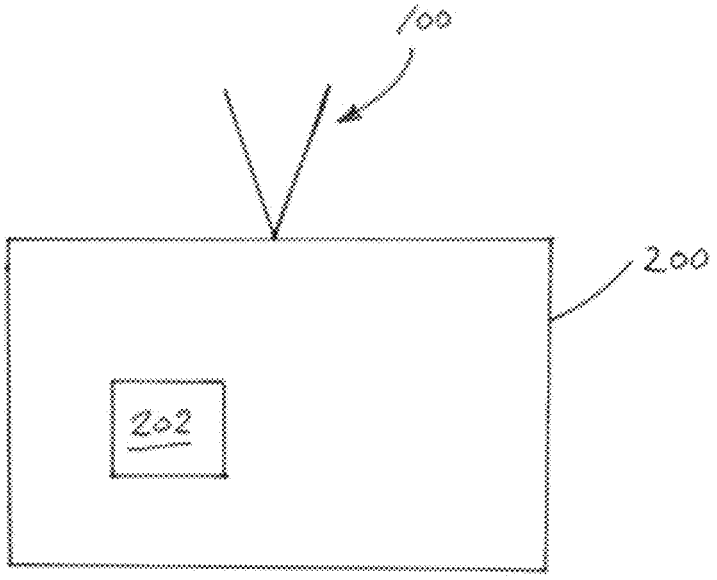
FIG. 11 is a schematic block diagram of an electronic apparatus having at least one antenna according to the invention.

FIG. 11 depicts an electronic apparatus 200 having at least one antenna 100 according to the invention. The apparatus 200, which may comprise a base station for a RFID tag location system, comprises antenna 100 to provide circularly polarized transmission and reception of signals. The signals of antenna 100 are applied to a processor 202 for determining RFID tag location within the coverage area of the base station 200.

In one embodiment where the apparatus has more than one antenna 100, the plurality of antennas may conveniently share a ground plane.

While the base station 200 of FIG. 11 may delineate the location of a transmitting RFID tag in the sense that it tells where the tag is likely located relative to the base station, a system may be provided comprising a number of such base stations 200 and a decision as to the location of a transmitting tag is made on the basis of decisions made by a number of the base stations; in other words, by triangulation.

In one embodiment of the system comprising a plurality of base stations 200, the system of multiple base stations and multiple tags can be either synchronous or asynchronous. In a synchronous embodiment, the base stations are synchronized to each other and, illustratively, time is divided into frames of time slots. Tags synchronize themselves to the frame, during a preselected time slot they obtain a time slot assignment (using a contention protocol) and thereafter transmit on the assigned time slot. In an asynchronous embodiment tags employ a contention protocol throughout.

In an embodiment of the present invention, a cuboids dielectric resonator loaded elliptical helical antenna 100 is provided for transmission/reception of circularly polarized signals from and to both RFID tags and RFID readers.

It will be understood that the foregoing description of an embodiment of the invention comprising an antenna forming part of a RFID base station is provided by way of example only and is not limitative of the applications of the antenna according to the invention.

It can be seen therefore that the invention provides an antenna comprising a helical winding with a loading formed of a dielectric material. The dielectric material comprises a plurality of individual dielectric elements arranged together to form a generally tubular structure adjacent the helical winding. The helical winding has a longitudinal axis whereby a cross-sectional area of said helical winding in a plane perpendicular to said longitudinal axis has a major axis and a minor axis perpendicular to the major axis.

It can also be seen that the one or more of the individual dielectric elements may have a square cross-sectional area in the plane perpendicular to the longitudinal axis of the helical winding or that each of the individual dielectric elements has a square cross-sectional area in a plane perpendicular to the longitudinal axis of the helical winding. The individual dielectric elements may have a square cross-sectional area in the plane perpendicular to the longitudinal axis of the helical winding along a major part of their lengths.

It can also be seen that the helical winding is substantially elliptical in the plane perpendicular to the longitudinal axis of said helical winding. Alternatively or additionally, the helical winding may not be uniformly elliptical in the plane perpendicular to the longitudinal axis of the helical winding. For example, the helical winding may be ovoid in the plane perpendicular to the longitudinal axis of the helical winding.

It can further be seen that the dielectric elements are elongate cuboid elements. The dielectric elements may extend for the full or a major part of the height of the antenna. In some embodiments, the dielectric elements are shorter than the height of the antenna. In some embodiments, the spacing between the winding and the dielectric elements may be uniform and the dielectric elements may be provided on the inside of the helical winding.

It can also be seen that the helical winding is Formed from at least one elongate, electrically conductive element. The at least one elongate, electrically conductive element may comprise a metal wire. The at least one elongate, electrically conductive element may comprise a first main elongate, electrically conductive element and a second, parasitic elongate, electrically conductive element.

The invention also provides an electronic apparatus having an antenna according to the invention.

The invention also provides a radio frequency identifier (RFID) base station comprising at least one antenna according to the invention.

While the invention has been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

In general, the present application teaches an integrated wire elliptical helical antenna with novel cuboids dielectric resonator loading for circularly polarized wave transmission and reception. In one embodiment, the antenna is designed to operate in a centre frequency of 915 MHz and it is utilized in RFID systems as a base station antenna, although other uses are envisaged. The elliptical structure is formed by steel wire and supporting acrylic plastic. The cuboids dielectric resonator is loaded at the inner surface of the antenna, i.e. on the inside of the helical winding.

TABLE 1

Antenna 100 Dimensions

| | Parameters | | | |
|---|---|---|---|---|
| | H1 | A1 | A2 | B1 |
| Values/mm | 330 | 54.4 | 17.5 | 215.4 |
| | Parameters | | | |
| | B2 | E1 | H2 | G1 |
| Values/mm | 68.2 | 95 | 10 | 230 |
| | Parameters | | | |
| | E2 | D1 | | |
| Values/mm | 16 | 4 | | |

TABLE 2

Matching Circuit Parameters and Values

| | Parameters | | | |
|---|---|---|---|---|
| | $\epsilon_r$ | Thickness | Inductance | Capacitance |
| Values/mm | 4.6 | 1.6 mm | 15 nH | 1.8 pH |
| | Parameters | | | |
| | P1 | P2 | P3 | P4 |
| Values/mm | 4 | 6.67 | 0.6 | 1.1 |

| | Parameters | | | | |
|---|---|---|---|---|---|
| | P5 | P6 | P7 | P8 | P9 |
| Values/mm | 3 | 1.15 | 0.6 | 18 | 12 |

The invention claimed is:

1. An antenna comprising a helical winding surrounding a helix core with a loading formed of a dielectric material, wherein said dielectric material comprises a plurality of spaced individual dielectric elements, such that the plurality of individual dielectric elements are arranged together to define a generally tubular cavity within the helical winding, the plurality of individual dielectric elements being affixed to only an inner side of said helical winding, said helical winding having a longitudinal axis whereby a cross-sectional area of said helical winding in a plane perpendicular to said longitudinal axis has a major axis and a minor axis perpendicular to the major axis, wherein the major axis and the minor axis have different lengths.

2. An antenna as claimed in claim 1 wherein one or more of the individual dielectric elements has a square cross-sectional area in the plane perpendicular to the longitudinal axis of the helical winding.

3. An antenna as claimed in claim 2 wherein one or more of the individual dielectric elements have a square cross-sectional area in the plane perpendicular to the longitudinal axis of the helical winding along a major part of their lengths.

4. An antenna as claimed in claim 1 wherein each of the individual dielectric elements has a square cross-sectional area in the plane perpendicular to the longitudinal axis of the helical winding.

5. An antenna as claimed in claim 1 wherein the helical winding is elliptical in the plane perpendicular to the longitudinal axis of said helical winding.

6. An antenna as claimed in claim 5 wherein the helical winding is not uniformly elliptical in the plane perpendicular to the longitudinal axis of the helical winding.

7. An antenna as claimed in claim 1 wherein the dielectric elements are elongate cuboid elements.

8. An antenna as claimed in claim 1 wherein the dielectric elements extend for the height of the antenna.

9. An antenna as claimed in claim 1 wherein the dielectric elements are shorter than the height of the antenna.

10. An antenna as claimed in claim 1 wherein the spacing between the helical winding and the dielectric elements is uniform.

11. An antenna as claimed in claim 1 wherein the dielectric elements are provided on the inside of the helical winding.

12. An antenna as claimed in claim 1 further comprising a feed probe arranged as a side feed for the antenna.

13. An antenna as claimed in claim 12 wherein said feed probe comprises a straight metallic strip and a matching circuit.

14. An antenna as claimed in claim 1 wherein the helical winding is formed from at least one elongate, electrically conductive element.

15. An antenna as claimed in claim 14 wherein the at least one elongate, electrically conductive element comprises a metal wire.

16. An antenna as claimed in claim 14 wherein the at least one elongate, electrically conductive element comprises a first main elongate, electrically conductive element and a second, parasitic elongate, electrically conductive element.

17. An electronic apparatus having an antenna according to claim 1.

18. A radio frequency identifier (RFID) base station comprising at least one antenna as claimed in claim 1.

* * * * *